US007637775B2

(12) United States Patent
Chang

(10) Patent No.: US 7,637,775 B2
(45) Date of Patent: Dec. 29, 2009

(54) CONNECTOR CARRIER HAVING QUICK RELEASE

(75) Inventor: Chun-Yi Chang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,407

(22) Filed: Dec. 22, 2008

(65) Prior Publication Data

US 2009/0163077 A1 Jun. 25, 2009

(30) Foreign Application Priority Data

Dec. 21, 2007 (CN) ..... 2007 2 0131642 U

(51) Int. Cl.
*H01R 13/40* (2006.01)

(52) U.S. Cl. ..... 439/594; 439/331

(58) Field of Classification Search ..... 439/65, 439/68, 74, 330, 331, 594, 701, 717
See application file for complete search history.

(56) References Cited

U.S. PATENT DOCUMENTS

| | | | | |
|---|---|---|---|---|
| 6,679,707 | B1 | 1/2004 | Brodsky et al. | |
| 6,945,799 | B2 | 9/2005 | Yuang | |
| 6,971,890 | B2 | 12/2005 | Ma | |
| 6,974,346 | B2 | 12/2005 | Liao | |
| 7,001,197 | B2 | 2/2006 | Shirai et al. | |
| 7,033,183 | B2 | 4/2006 | Ma | |
| 7,402,053 | B2 * | 7/2008 | Hougham et al. | 439/70 |
| 2008/0119085 | A1 * | 5/2008 | Liao et al. | 439/541.5 |

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

An electrical connector assembly comprises a carrier and an electrical connector with an insulative housing. The carrier has a base and a plurality of sidewalls extending downward from peripheral of the base and jointly defining a cavity. The carrier includes a plurality of claws and release sections associate with the claws. An electrical connector is received in the cavity and has alignment pins assembled to the electrical connector and engaged with the claws. Each alignment pin disengaged from the claw by the release section.

2 Claims, 5 Drawing Sheets

CONNECTOR CARRIER HAVING QUICK RELEASE

BACKGROUND OF THE INVENTION

1. Field of the Invention

The present invention relates to a carrier, and more particularly to a connector carrier having a quick release for efficiently retaining and releasing a connector therefrom.

2. Description of the prior Art

U.S. Pat. No. 7,001,197 issued to Shirai on Feb. 21, 2006 discloses a land grid array connector (LGA) connector comprises an insulative housing having a plurality of contacts. The insulative housing has a top surface for receiving a land grid array package. A cover member is pivotally mounted on a first end of the insulative housing. The cover member is pivotal between an open position and a closed position where the cover member presses the land grid array package toward the top surface of the insulative housing so that the land grid array package electrically connects to the contacts. A lever is pivotally mounted on a second end of the insulative housing. The lever has a locking portion for locking the cover member in the closed position. A metallic reinforcing plate is positioned on a bottom surface of the housing. The metallic reinforcing plate extends between the first end and the second end of the insulative housing. In this arrangement, the contacts protrude from the top surface of the insulative housing and have sold balls on tails. As FIG. 24B shown, the cover mounted upon the top surface of the insulative housing, the contacts is protected by the cover in transportation. The sold balls are positioned in a bottom surface of the insulative housing, they will be ok in the transportation.

U.S. Pat. No. 6,679,707 issued to Brodsky on Jan. 20, 2004 discloses a LGA. The land grid array connector connector is formed from a plurality of insulative sections holding by a frame. Specifically, each insulative section includes at least one set fingers. Each set of fingers interconnects with a set of fingers of another section to form the LGA connector. By forming the LGA connector in this manner a maximum quantity of input/output contacts can be provided. The connector disclosed by Brodsky can be generally referred to as LGA/LGA type connector in which no solder joints are formed between the Brodsky connector and a mother board as the contact tails are protruding beyond the bottom surface of the connector. Accordingly, those contact engaging portion (upper) and contact tails (bottom) have to be well protected so as to keep its original true positions. Accordingly, a device for keeping the contact intact is disclosed.

SUMMARY OF THE INVENTION

Accordingly, an object of the present invention is to provide a connector carrier with a quick release, the carrier placed upon an electrical connector for protecting contacts of the electrical connector and preventing the carrier from interfere with other electrical members which disposed on a printed circuit board.

In order to achieve the object set forth, a carrier for an electrical connector to be placed upon the electrical connector comprises a base with a flat upper surface and a plurality of anchoring devices formed on the base. Each anchoring device includes a claw and a release section associated with the claw.

In order to further achieve the object set forth, an electrical connector assembly comprises a carrier and an electrical connector with an insulative housing. The carrier has a base and a plurality of sidewalls extending downward from peripheral of the base and jointly defining a cavity. The carrier includes a plurality of claws and release sections associate with the claws. An electrical connector is received in the cavity and has alignment pins assembled to the electrical connector and engaged with the claws. Each alignment pin disengaged from the claw by the release section.

DESCRIPTION OF PREFERRED EMBODIMENT

Figure 1:
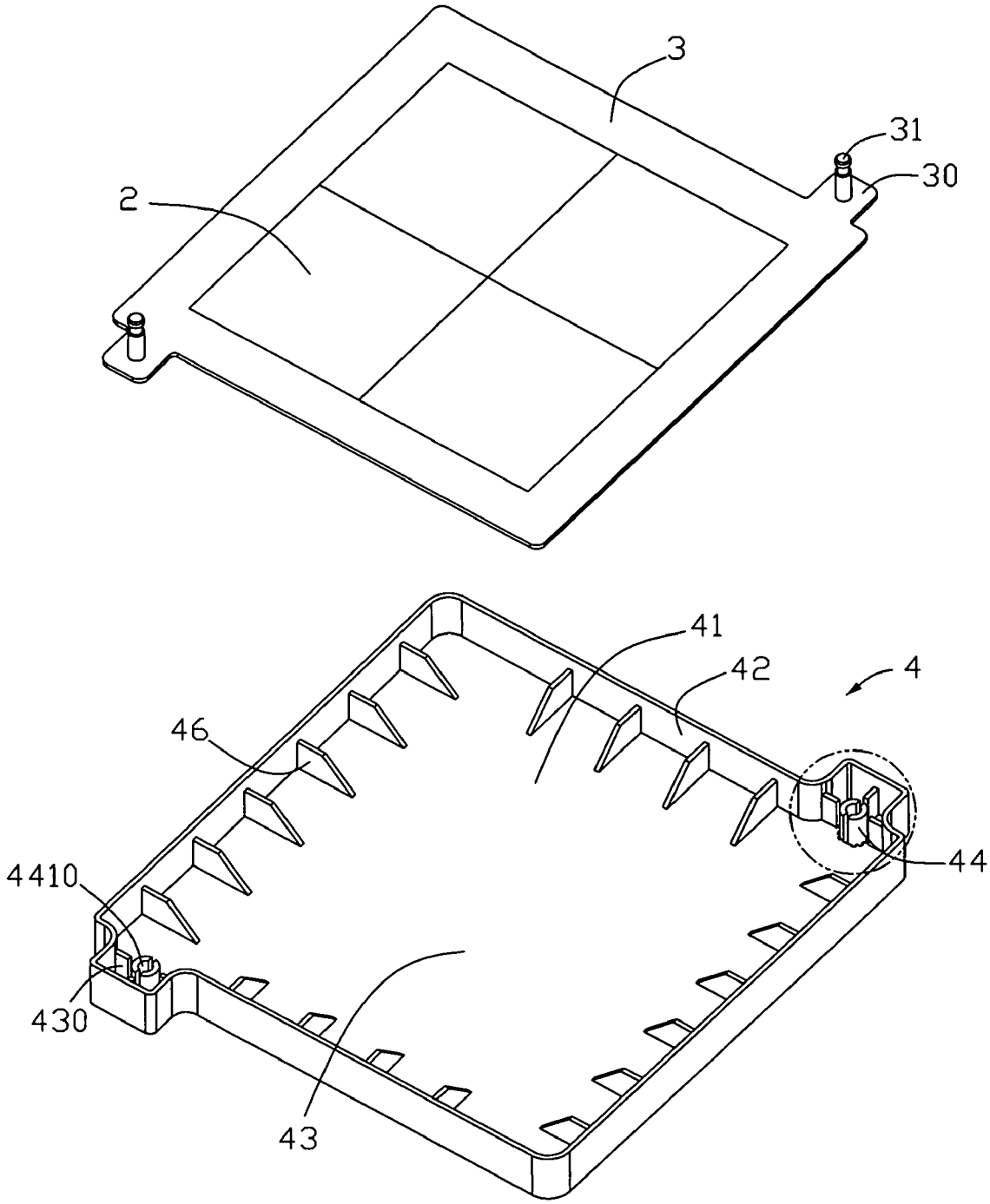
FIG. 1 is an exploded view of an electrical connector assembly in accordance of the present invention.
Figure 2:
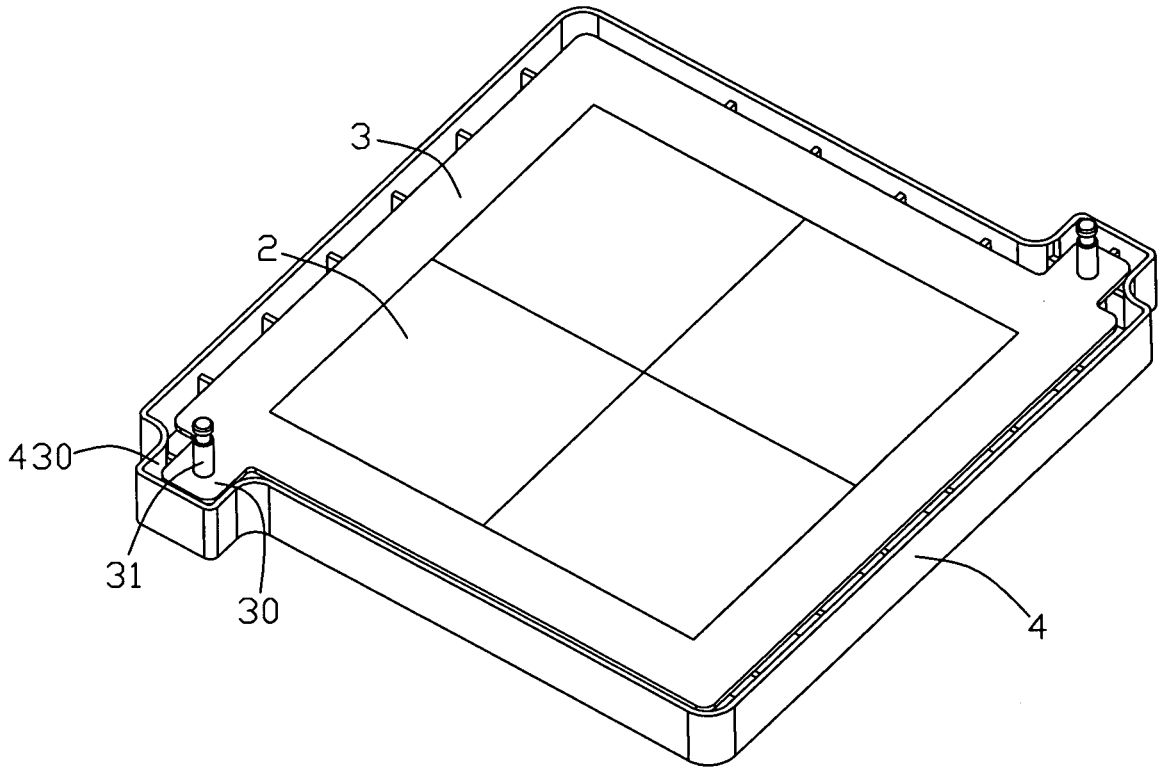
FIG. 2 is an assembled view of the electrical connector assembly of FIG. 1.
Figure 3:
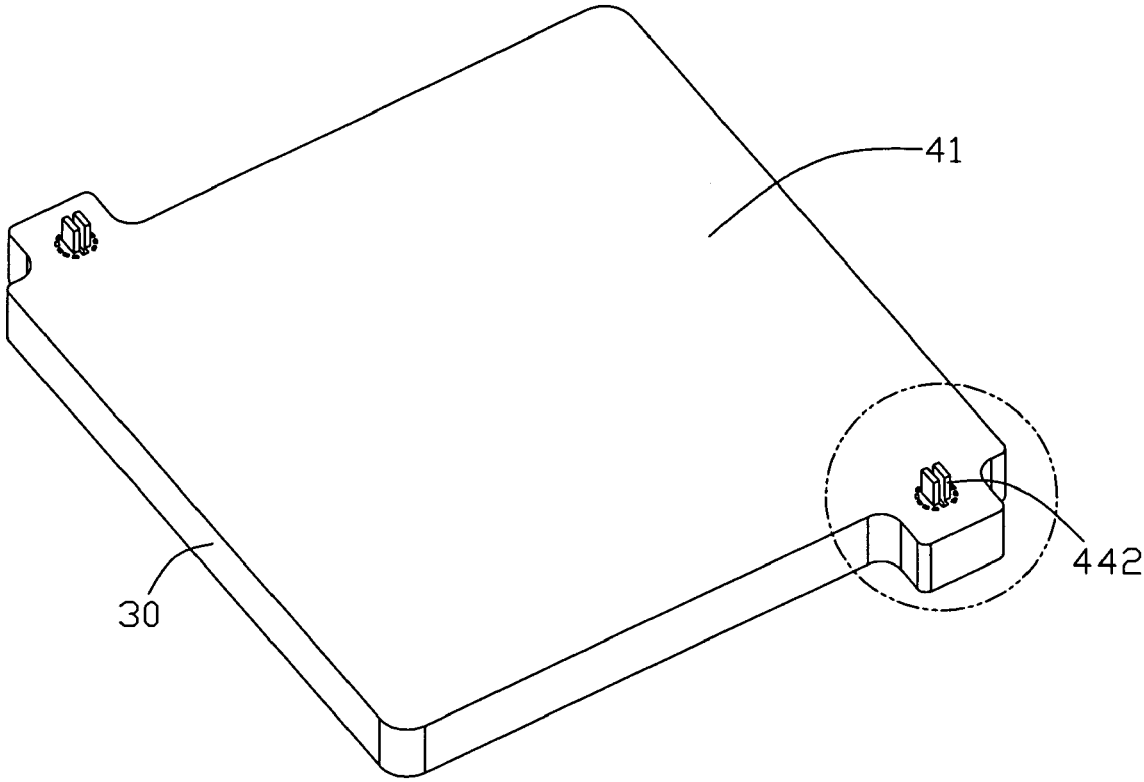
FIG. 3 is an assembled view of the electrical connector assembly of FIG. 1, shown a bottom surface of a carrier.
Figure 4:
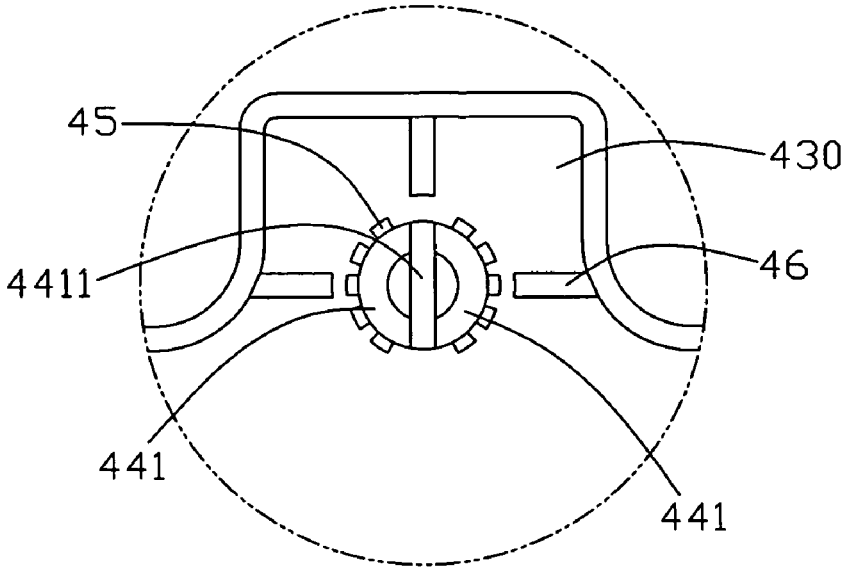
FIG. 4 is a partially exploded view of the electrical connector assembly of FIG. 1.
Figure 5:
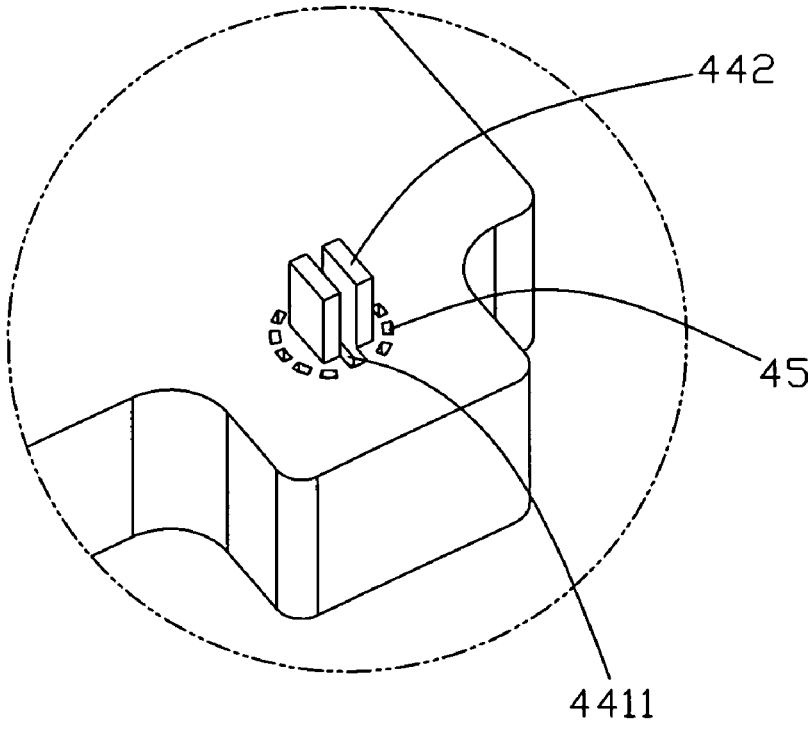
FIG. 5 is a partially exploded view of the electrical connector assembly of FIG 3.

Reference will now be made to the drawings to describe the present invention in detail.

Referring to FIG. 1 to FIG. 5, an electrical connector assembly of the present invention used to connect an electronic package (not shown) and a printed circuit board (not shown) comprises an electrical connector and a carrier 4 covered the electrical connector. The electrical connector comprises an insulative housing 2 formed by a plurality of separated insulative sections with a plurality of contacts (not shown) received in the insulative housing 2 and a frame 3 assembled the insulative sections together as a whole insulative housing 2.

Each insulative section is substantially plate board and interconnected with each other to form the insulative housing 2. The frame 3 is fitted on the insulative housing 2 to hold the insulative sections. The frame 3 is substantially rectangular. The frame 3 has a pair of tongues 30 extending outwardly on a pair of diagonal corners thereof. A pair of metal alignment pins 31 are secured in holes of the tongues 3. Each alignment pin 31 is partially extending above an upper surface of the tongue 30 with an upper portion 311 to engage with the carrier 4 and partially extending below a bottom surface of the tongue 30 with a lower portion 312 to engage with the printed circuit board.

The carrier 4 comprises a planar board as a base 41 and a plurality of sidewalls 42 extending downwardly from periphery of the base 41. The base 41 and the sidewalls 42 together form a cavity 43 to completely cover the electrical connector. The base 41 is substantially rectangular and has a pair of projections 430 for receiving the tongues 30. An anchoring device 44 is disposed on the projection 430 of the cavity 43. The anchoring device 44 includes a claw 441 extending downwardly from the base 41 in the cavity 43 and a release section 442 opposite to the claw 441 and extending upwardly from the base 41. The claw 441 rounds as a circle to form a receiving chamber 4410 to receive the alignment pins 31. The claw 441 has a slot 4411 extending thereof to separate the claw into two-pieces and pass through the base 41. The release section 442 includes a pair of parallel plates disposed at opposite sides of the slot 4411. In operation, compress the release section 442 to make the two parallel plates move toward each other, while the claw 441 spread. A plurality of channels 45 pass through the base 41 and adjacent to the claw 441 at an outer side for increasing flexibility of the claw 441. A plurality of ribs 46 are positioned between the base 41 and the sidewalls 42 and have the same height as the claw 441. The ribs 46 are adapted to increase the intensity between the base 41 and the sidewalls 42 and supporting the electrical connector in the cavity 43.

Figure 6:
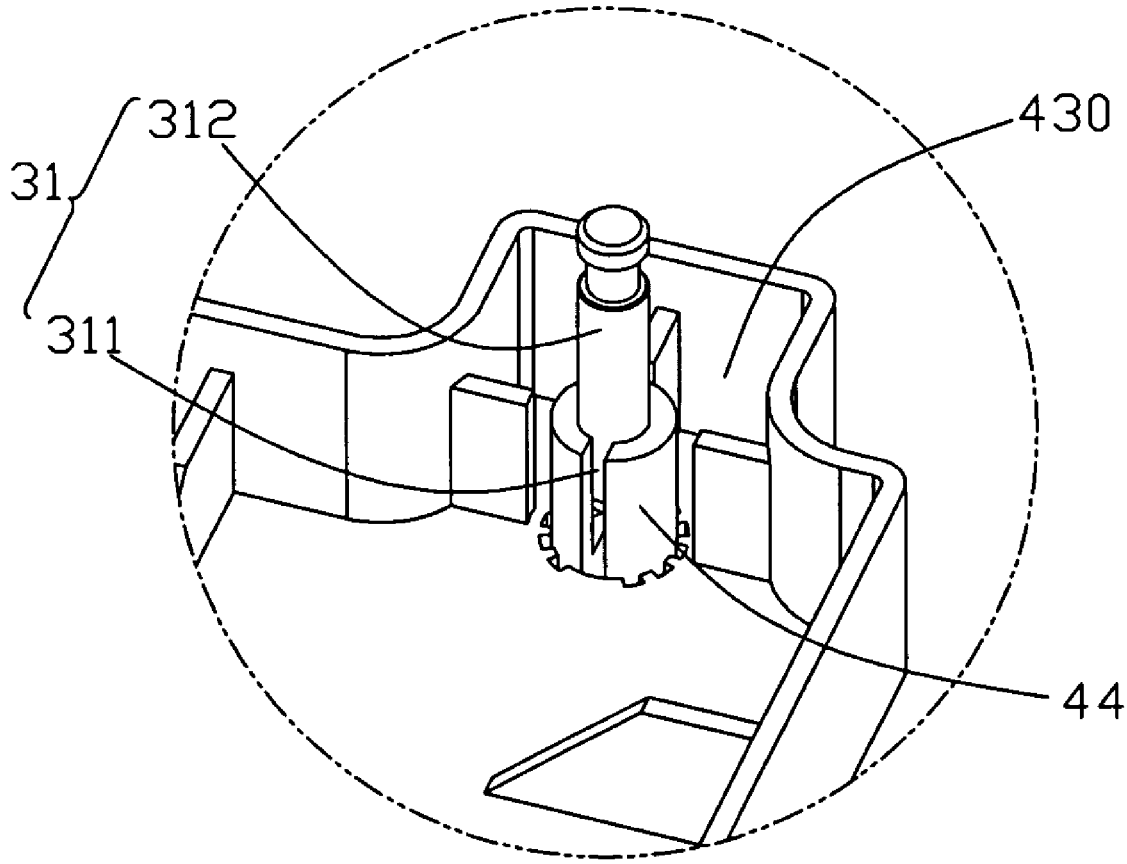
FIG. 6 is a partially schematic view of the electrical connector assembly, shown an alignment pin engaged with the carrier.

As shown in FIG. 6, the alignment pins 31 and the claws 441 have been designed, so assemble the carrier 4 and the electrical connector together just need press the alignment pins 31 of the electrical connector into the receiving chamber 4410 of the carrier 4, then the alignment pins 31 are engaged with the claws 441. Afterwards, we can use a vacuum suction device (not shown) to move the electrical connector onto the printed circuit board and the lower portions 312 of the alignment pins 31 engaged with the holes (not shown) of the printed circuit board, and then disassemble the carrier 4 from the electrical connector. When disassemble the carrier 4 from the electrical connector, just press the release section 442, and the claw 441 is opened and then operator can use fingers or mechanical to take off the carrier 4.

The advantages of the present invention are: first, the electrical connector and the carrier 4 is assembled together by alignment pins 31 and anchoring devices 44 that facilitate the assemble process; second, the alignment pins 31 and claws 441 are not disposed at edges of the electrical connector and the carrier 4, respectively, so when assemble and disassemble the electrical connector and the carrier 4, the carrier 4 will not interfere with other electrical elements which disposed on the printed circuit board adjacent the electrical connector; third, the carrier 4 has a plurality of sidewalls 42 that could prevent the dust polluting the contacts.

In the present invention, the alignment pins 31 are disposed on the frame 3, they also could be disposed on the insulative housing 2. If the electrical connector further comprises a fasten mechanism, the alignment pins 31 also could disposed on the fasten mechanism. The fasten mechanism could comprise a stiffener for receiving the insulative housing, a load plate pivotally mounted on one end of the stiffener and a lever pivotally mounted on the other end of the stiffener to lock the load plate and the stiffener. The position and number of the alignment pins 31 and anchoring devices 44 are not limit by the above embodiment.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A carrier for an electrical connector to be placed upon the electrical connector, comprising: a base with a flat upper surface; a plurality of anchoring devices formed on the base, each anchoring device including a claw and a release section associated with the claw, wherein the base has a plurality of sidewalls extending downward from peripheral of the base and jointly defining a cavity, wherein a plurality of ribs are defined between the base and the sidewalls, wherein the ribs and the claws are at the same height, wherein the base has projections extending outward, and the anchoring devices is formed on the projections, wherein the claw extends downward from the base and the release section extends upward from the base, wherein the claw has slots to separate the claw into a plurality of pieces, and the slots extend and pass through the base to form a cutout on the base, wherein the release section is disposed on edges of the cutout, wherein a plurality of channels are defined on the base and at an outer side of the claw.

2. An electrical connector assembly comprising: a carrier having a base and a plurality of sidewalls extending downward from peripheral of the base and jointly defining a cavity, the carrier including a plurality of claws and release sections associate with the claws; an electrical connector received in the cavity, and including an insulative housing ; and alignment pins assembled to the electrical connector and engaged with the claws, each alignment pin disengaged from the claw by the release section, wherein the insulative housing comprises a plurality of insulative sections, further comprising a frame fitted over the insulative housing, wherein the frame has tongues extending outward therefrom to provide an area for the alignment pins and the base of the carrier has projections extending outward to provide an area for the claws, wherein the alignment pin is partially disposed above the tongue and partially disposed below the tongue, wherein a plurality of ribs are formed between the base and the sidewalls and at the same height as the claws, wherein the claw forms a receiving chamber to receive the alignment pin.

* * * * *